US005548849A

United States Patent [19]

Sulit

[11] Patent Number: 5,548,849

[45] Date of Patent: Aug. 27, 1996

[54] WATER CONSERVATION DEVICE AND A METHOD OF INSTALLING THE SAME IN A TOILET TANK

[76] Inventor: Antonio M. Sulit, 3919 - 54 Street, Edmonton, Albterta, Canada, T6L 2E2

[21] Appl. No.: 430,844

[22] Filed: Apr. 28, 1995

[51] Int. Cl.[6] ..... E03D 1/14

[52] U.S. Cl. ..... 4/325; 4/324; 4/415

[58] Field of Search ..... 4/324, 325, 366, 4/405, 412, 415; 137/409, 410, 426

[56] References Cited

U.S. PATENT DOCUMENTS

| | | | |
|---|---|---|---|
| 1,353,333 | 9/1920 | Gervais | 16/194 |
| 1,667,990 | 5/1928 | Rogers | 4/412 |
| 2,074,347 | 3/1937 | Steiner | 16/194 |
| 3,274,733 | 9/1966 | Bailey | 16/81 |
| 3,590,395 | 7/1971 | Wustner | 4/324 |
| 3,775,778 | 12/1973 | Lee | 4/412 |
| 4,080,669 | 3/1978 | Biggerstaff | 4/325 |
| 4,117,556 | 10/1978 | Semler | 4/325 |
| 4,138,749 | 2/1979 | Clark | 4/324 |
| 4,144,600 | 3/1979 | Mayes | 4/324 |
| 4,160,294 | 7/1979 | Crumby | 4/324 |
| 4,216,555 | 8/1980 | Detjen | 4/324 |
| 4,224,703 | 9/1980 | Makhobey | 4/324 |
| 4,651,359 | 3/1987 | Battle | 4/324 |
| 4,748,699 | 6/1988 | Stevens | 4/324 |
| 4,868,933 | 9/1989 | Chen | 4/415 |
| 4,928,327 | 5/1990 | Kuhn | 4/324 |
| 4,945,578 | 8/1990 | Jomhs et al. | 4/391 |
| 5,105,480 | 4/1992 | Howell et al. | 4/412 |
| 5,157,796 | 10/1992 | Boyer et al. | 4/392 |
| 5,185,891 | 2/1993 | Rise | 4/324 |
| 5,195,189 | 3/1993 | Gibb | 4/325 |
| 5,289,594 | 3/1994 | Wiewiorowski et al. | 4/325 |
| 5,341,522 | 8/1994 | Munro | 4/324 |

*Primary Examiner*—Henry J. Recla
*Assistant Examiner*—Charles R. Eloshway
*Attorney, Agent, or Firm*—Anthony R. Lambert

[57] ABSTRACT

A method of conserving water in a toilet tank. Firstly, provide a line having a first end and a second end. Secondly, secure the first end of the line to adjacent a peripheral edge of a flapper valve. Attachment can either be made to the flapper valve itself or to the base of the pull chain that extends from the flapper valve to the flush mechanism. Thirdly, secure the second end of the line to a float floating in the toilet tank. Fourthly, use a plurality of direction altering line guides to orient the line such that when the flapper valve is in the open position and the water level falls, the lowering of the float exerts a force upon the line thereby pulling the float into the closed position.

7 Claims, 3 Drawing Sheets

WATER CONSERVATION DEVICE AND A METHOD OF INSTALLING THE SAME IN A TOILET TANK

FIELD OF THE INVENTION

The present invention relates to a water conservation device for a toilet tank which causes a flapper valve to close prematurely thereby conserving water.

BACKGROUND OF THE INVENTION

Toilet tanks have a flapper valve, which is pulled into an open position by the flush mechanism. Once the flapper valve is in the open position, water flows from the toilet tank into the toilet bowl. Most devices intended to conserve water in a toilet cause the flapper valve to close before all of the water has been drained from the toilet tank. The differences between the mechanisms involve the manner in which they act upon the flapper valve. One group of patents; such as U.S. Pat. No. 4,945,578 exert a force on top of the flapper valve to push it to a closed position. Another group of patents, such as U.S. Pat. No. 5,341,522, pull the flapper valve into the closed position.

As this class of water conservation devices has evolved they have gradually decreased in complexity and cost, while increasing in effectiveness and ease of installation.

SUMMARY OF THE INVENTION

What is required is an improved form of water conservation device that is simpler, less expensive to manufacture, more effective and easier to install than the majority of the prior art devices.

According to one aspect of the present invention there is provided a method of conserving water in a toilet tank. In order to understand the teachings of the present method one must understand the structure of a toilet tank. A toilet tank has a peripheral sidewall, a bottom, a drain passageway through the bottom, and a flapper valve controlling flow through the drain passageway. Firstly, provide a line having a first end and a second end. Secondly, secure the first end of the line to adjacent a peripheral edge of the flapper valve. Attachment can either be made to the flapper valve itself or to the base of the pull chain that extends from the flapper valve to the flush mechanism. Thirdly, secure the second end of the line to a float floating in the water of the toilet tank. Fourthly, use a plurality of direction altering line guides to orient the line such that when the flapper valve is in the open position and the water level falls, the lowering of the float exerts a force upon the line thereby pulling the float into the closed position.

In accordance with the teachings of the present invention, the flapper valve and the float are tied together. As the float falls, the flapper valve is pulled back into a closed position. Just two line guides are required. One line guide is positioned on the bottom of the toilet tank adjacent to the flapper valve. A second line guide is positioned to a sidewall of the toilet tank, preferably to the top peripheral edge.

According to another aspect of the present invention there is provided a kit for a water conservation device for toilet tanks. The kit need consist of only three components. A first direction altering line guide is required having means to maintain the line guide on the bottom of a toilet tank. A second direction altering line guide is required having means to attach to a sidewall of a toilet tank. A length of line is required for threading through the line guides and attachment to the flapper valve and float in accordance with the teachings of the method.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The preferred method of conserving water in a toilet tank will now be described with reference to FIGS. 1 through 3.

Figure 1:
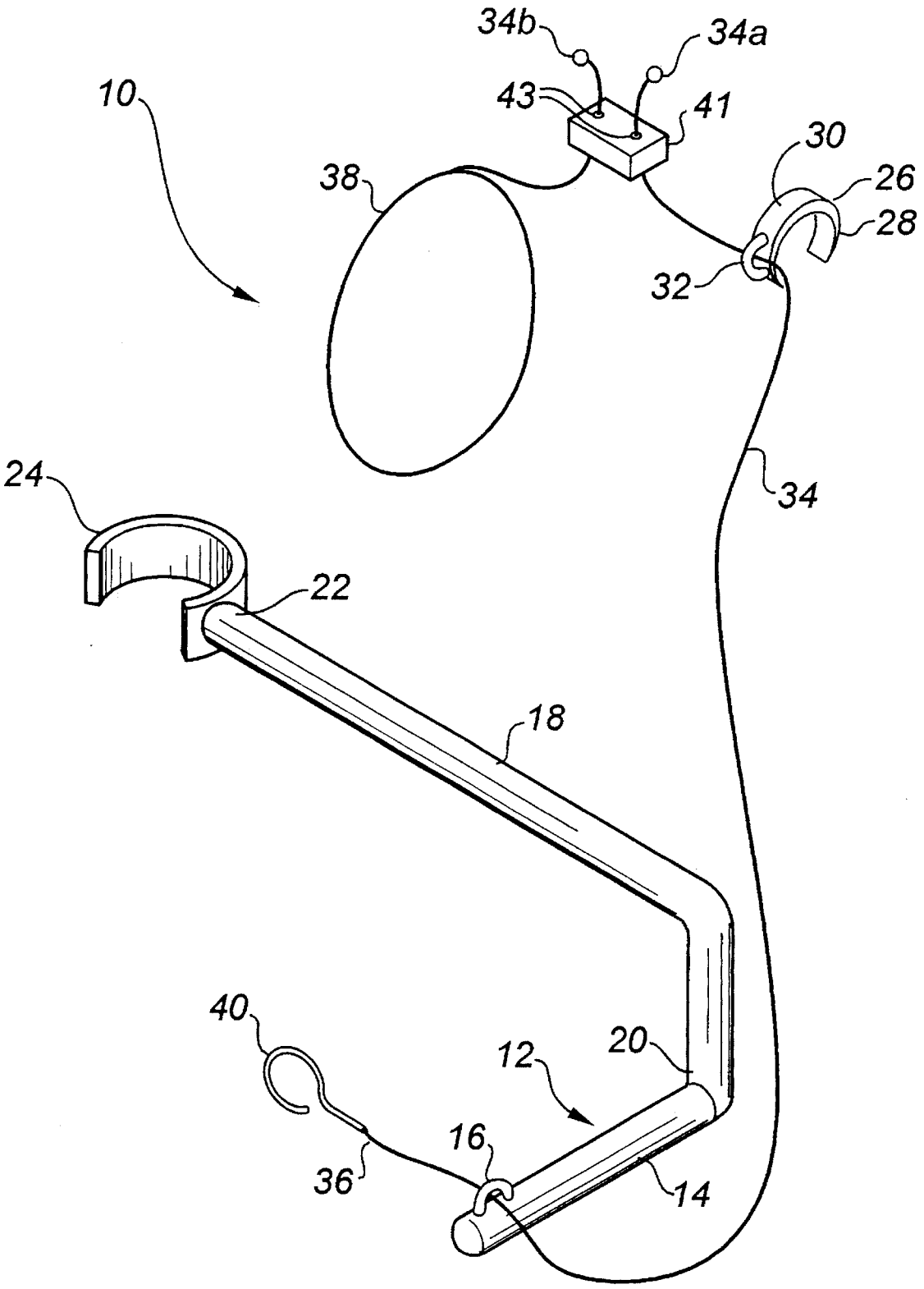
FIG. 1 is a perspective view of the components of a water conservation kit, constructed in accordance with the teachings of the method.
Figure 2:
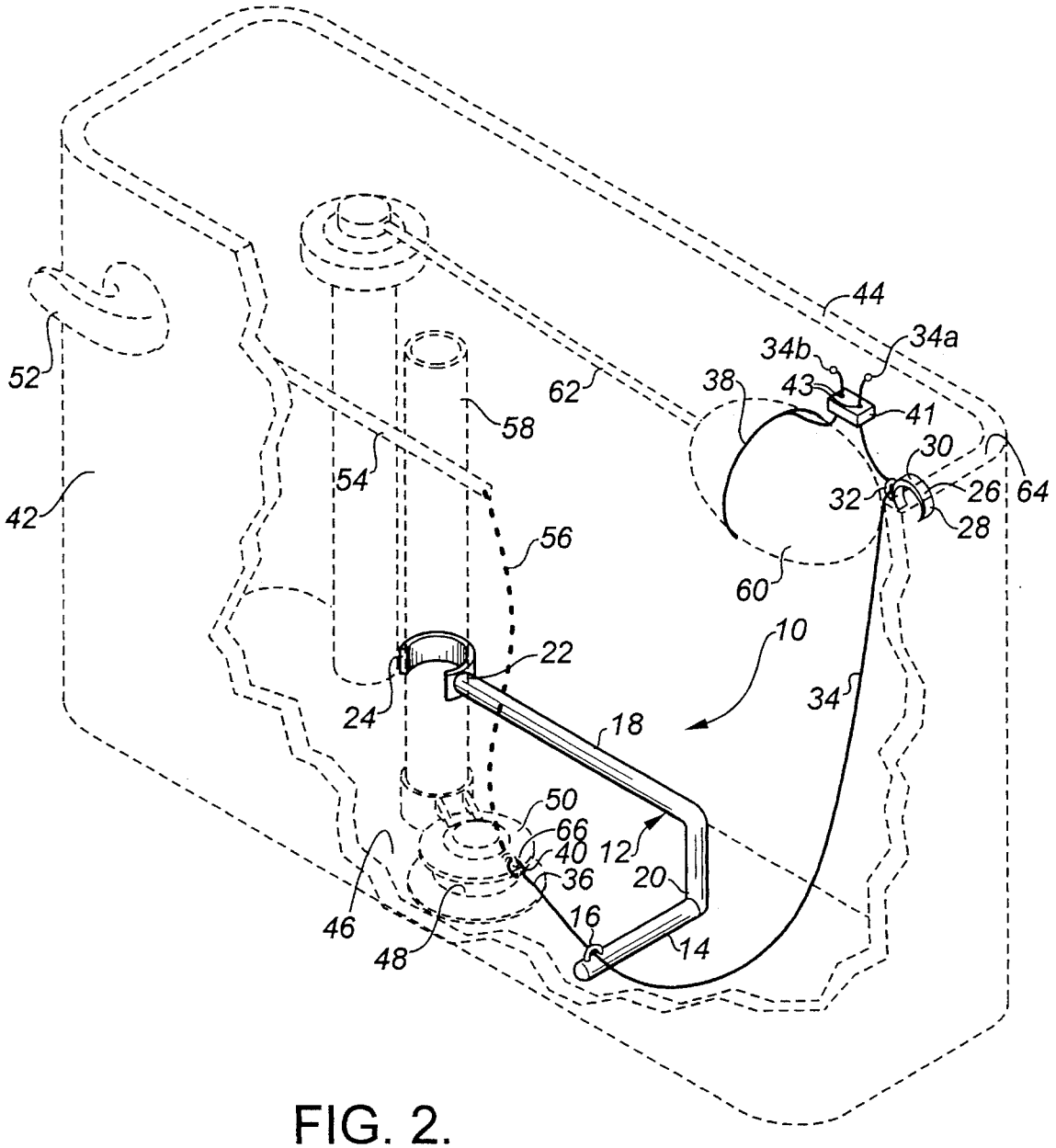
FIG. 2 is a partially cut away perspective view of the kit illustrated in FIG. 1 installed in a toilet having a float.

Referring to FIG. 1, there is illustrated a kit of components necessary to modify a toilet in accordance with the teaching of the present method. Kit 10 includes a first direction altering line guide 12. First direction altering line guide 12 includes a base 14 that supports an eyelet 16. A generally "L" shaped arm 18 is provided having a first end 20 and a second end 22. First end 20 is attached substantially perpendicularly to base 14. Second end 22 has a clip-form attachment member 24, by means of which second end 22 of arm 18 is attached to internal components of a toilet such as a standpipe as will hereinafter be further described. A second direction altering line guide 26 is provided. Second direction altering line guide 26 is has a clip-form body 28 having an exterior surface 30 with an eyelet 32. A length of line 34 is provided having a first end 36 and a second end 38. First end has a hook 40. A line splicing member 41 is provided to adjust the length of line 34. This is done to control the amount of water released with each flush, as will hereinafter be further described with respect to the method.

The use and means of installation of kit 10 will now be described with reference to FIGS. 1 through 3. FIG. 2 discloses a common configuration for a toilet tank 42. Toilet tank 42 has a peripheral sidewall 44, a bottom 46, and a drain passageway 48 through bottom 46. A flapper valve 50 is movable between an open position and a closed position to control the flow of water through drain passageway 48. In the closed position flapper valve 50 is positioned to block the flow through drain passageway 48. A handle 52 is attached to sidewall 44 of toilet tank 42. Attached to handle 52 is an actuating arm 54 that is, in turn, linked by means a chain 56 to flapper valve 50. When handle 52 is pressed downwardly, actuating arm 54 pivots and exerts a force upon chain 56 which pulls flapper valve 50 into the open position in which it is spaced from drain passageway 48. A standpipe 58 extends upwardly from bottom 46 of toilet tank 42. A float 60 is secured by means of a pivotally mounted arm 62. Float 60 rises and falls with the level of water in toilet tank 42. The method consists of the following steps. Firstly, first line guide 12 is positioned with base 14 on bottom 46 of toilet tank 42 adjacent flapper valve 50. In order to prevent movement of base 14, clip-form attachment member 24 at second end 22 of "L" shaped arm 18 is clipped onto standpipe 58. Secondly, second line guide 26 is positioned adjacent to a top peripheral edge 64 of sidewall 44 of toilet tank 42. This is accomplished by placing clip-form body 28 of second line guide 26 over top peripheral edge 64. Thirdly, threading first end 36 of line 34 through eyelet 16 of first line guide 12 and second end 38 of line 34 through eyelet 32 of second line guide 26. Once first end 36 of line 34 is threaded through eyelet 16 on first line guide 12, it is secured by means hook 40 to chain 56 in a position adjacent a peripheral edge 66 of flapper valve 50. Once second end 38 of line 34 is threaded through eyelet 32 of second line guide 26 it is secured to float 60. Float 60, of course, floats in the water of toilet tank 42. When flapper valve 50 is in the open position and the water level in toilet tank starts to fall, the lowering of float 60 exerts a force upon line 34. This force is directed through first line guide 12 and second line guide 26 to pull flapper valve 50 into the closed position. By prematurely pulling flapper valve 50 into the closed position water is saved. The amount of water saved depends upon the length of line 34. A shorter line will, of course, pull flapper valve 50 into the closed position more rapidly. The length of line 34 is controlled by placing long the length of line 34 line splicing member 41. Splicing member 41 has two apertures 43 and 45 which hold two portions of line 34 designated as 34*a* and 34*b*, respectively. The length of either portion 34*a* or 34*b* can be shortened by pulling them further through splicing member 41.

Figure 3:
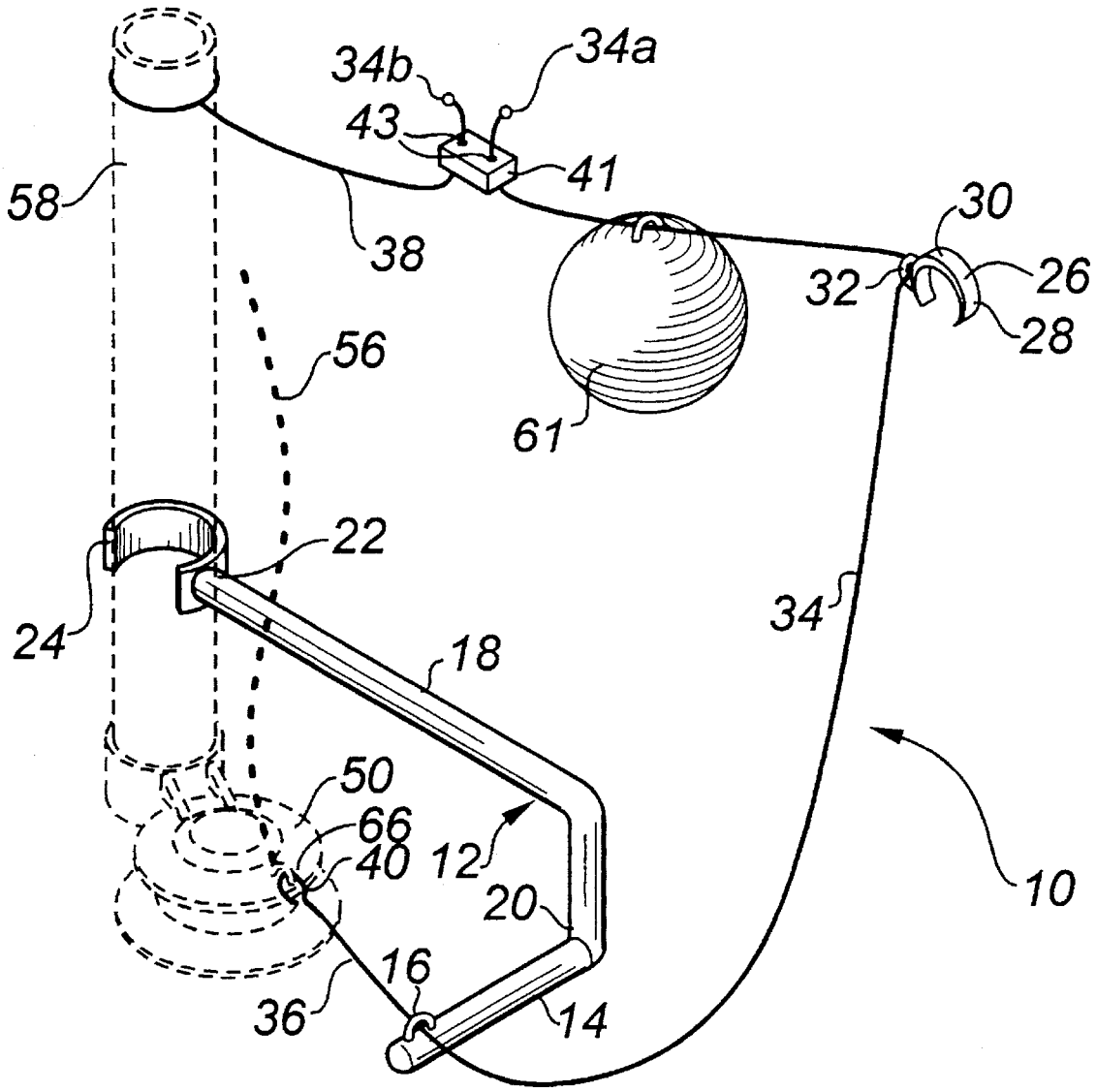
FIG. 3 is a partially cut away perspective view of the kit illustrated in FIG. 1 installed in a toilet not having a float.

Referring to FIG. 3, there is illustrated a slight variation in the teaching of the method required when the toilet tank does not have a float mechanism. In such a case, line guides 12 and 26 are positioned as previously described. However, second end 38 of line 34 must be attached to standpipe 58 and a float 61 hung onto line 34 in order to exert a force upon line 34 when the water level falls. It is preferred that float 61 be partially filled with water. When partially filled with water float 61 will still float, and yet it will have sufficient weight to pull down upon line 34.

It will be apparent to one skilled in the art that modifications may be made to the illustrated embodiment without departing from the spirit and scope of the invention as defined by the Claims.

The embodiments of the invention in which an exclusive property or privilege is claimed are as follows:

1. A method of conserving water in a toilet tank having a peripheral sidewall, a bottom, a drain passageway through the bottom, and a flapper valve movable between an open position and a closed position to control the flow of water through the drain passageway, comprising the steps of:

providing a line having a first end and a second end;

securing the first end of the line to adjacent a peripheral edge of the flapper valve;

securing the second end of the line to a float floating in the water of the toilet tank; and using a plurality of direction altering line guides to guide the line at specific points in the tank such that when the flapper valve is in the open position and the water in the tank flows through the drain passageway, the lowering of the float exerts a force upon the line thereby pulling the line past said points to move the flapper valve into the closed position.

2. A method of conserving water in a toilet tank having a peripheral sidewall, a bottom, a drain passageway through the bottom, and a flapper valve movable between an open and a closed position to control the flow of water through the drain passageway, comprising the steps of:

positioning a first line guide on the bottom of the toilet tank adjacent the flapper valve;

securing a second line guide adjacent to a top peripheral edge of the sidewall of the toilet tank;

taking a line having a first end and a second and, threading the first end through the first line guide and securing said first end adjacent a peripheral edge of the flapper valve, threading the second end through the second line guide and securing said second end to a float floating in the water of the toilet tank, such that when the flapper valve is in the open position and the water level falls, the lowering of the float exerts a force upon the line thereby pulling the flapper valve into the closed position.

3. A kit for a water conservation device for toilet tanks, comprising:

a first direction altering line guide maintained on a bottom of the toilet tank by means of an arm that has a first end adapted to be supported on said bottom and a second end having an attachment member whereby the second end of the arm is adapted to be attached to a standpipe located in said tank;

a second direction altering line guide having means for attachment to a sidewall of said toilet tank; and, a length of line, said line being guided by said line guides to pull a flapper valve located in the tank from an open position into a closed position thereby decreasing the amount of water released with each flush.

4. The kit as defined in claim 3, wherein the first direction altering line guide includes a base with an eyelet.

5. The kit as defined in claim 3, wherein the second direction altering line guide includes a clip having an exterior surface with an eyelet.

6. The kit as defined in claim 3, wherein means is provided to adjust the length of the line to control the amount of water released with each flush.

7. The kit as defined in claim 6, wherein the means to adjust the length of the line includes a line splicing member which divides the line into two portions and permits the length of each portion to be adjusted.

* * * * *